US005628211A

United States Patent [19]

Soucie

[11] Patent Number: 5,628,211

[45] Date of Patent: May 13, 1997

[54] APPARATUS FOR IMPROVING ATMOSPHERIC DYE MACHINES

[76] Inventor: Donald P. Soucie, 55 Walnut Hill Rd., Pascoag, R.I. 02859

[21] Appl. No.: 517,292

[22] Filed: Aug. 21, 1995

[51] Int. Cl.[6] ..... D06B 23/22

[52] U.S. Cl. ..... 68/15; 68/183

[58] Field of Search ..... 68/15, 183; 134/102.1, 134/102.2, 105; 122/31.1

[56] References Cited

U.S. PATENT DOCUMENTS

| | | | |
|---|---|---|---|
| 3,218,833 | 11/1965 | Booth | 68/15 X |
| 3,593,545 | 7/1971 | Blumenkamp | 68/15 |
| 3,614,798 | 10/1971 | Serbin | 8/149.3 X |
| 3,894,410 | 7/1975 | Fleissner | 68/5 D |
| 4,483,032 | 11/1984 | Christ Et El. | 8/149.1 |
| 4,697,291 | 10/1987 | Shepherd et al. | 68/183 X |
| 4,828,567 | 5/1989 | Robbins | 8/149.3 |

FOREIGN PATENT DOCUMENTS

| | | | |
|---|---|---|---|
| 661018 | 2/1929 | France | 68/183 |

*Primary Examiner*—Philip R. Coe

*Attorney, Agent, or Firm*—Scott B. Garrison; Gary E. Lambert

[57] ABSTRACT

A modification to atmospheric dye machines, in which the modification increases the attainable operating temperatures to a level in which polyester textiles can be successfully dyed. The modification is accomplished by relocating steam injection to a location which takes advantage of venturi principles and harnesses the slight pressurization obtained by injecting steam into the liquor. The combination increases circulation of dye liquor, convective heat transfer and minimizes the formation of isothermal layering of the dye liquor. Dye liquor subject to reheating is drawn from the tank bottom, further decreasing the amounts of cooler dye liquor which may still collect within the tank.

8 Claims, 1 Drawing Sheet

APPARATUS FOR IMPROVING ATMOSPHERIC DYE MACHINES

BACKGROUND OF THE INVENTION

The present invention relates to the textile industry. More particularly it relates to an improvement in a typical atmospheric dye machine. This improvement provides an atmospheric dye machine with the capability to attain and maintain higher temperatures which are otherwise not achievable.

A typical unmodified atmospheric dye machine contains a quantity of water, dye and some quantity of carrier agent. The liquor resulting from mixing these ingredients is heated typically by steam to the requisite temperature needed for the specific dye operation. A textile is mechanically conveyed through the heated liquor continuously until completion of the dying process.

The prior art machines which operate at atmospheric pressures are limited by the operating temperatures which they can maintain. An unmodified machine can reach temperatures of 195 degrees F. in the liquor bath. This temperature has proven to be the limit of such machines. To successfully dye polyester however, a threshold of 208 degrees F. is required. An unmodified atmospheric dye machine cannot attain temperatures in this range.

Modification of an atmospheric dyebeck to include a heat exchanger and a recirculation pump typically allow the operator to achieve temperatures as high as 206 degrees F. in the liquor bath, and the applicant is aware of a few rare instances when temperatures as high as 208 degrees F. have been reached. However, the problem with this modification is that the temperature is limited by the onset of pump cavitation which occurs at these temperatures. Although 208 degrees F. is theoretically possible, if this temperature were achieved it could not be maintained without the cavitation burning up the pump.

Until now, the only viable method which could successfully dye polyesters was to use a pressurized dye machine. Through the operation of pressure, higher temperatures could be maintained within the liquor bath and polyesters could be properly dyed. However, the cost to purchase pressurized dying equipment and the cost to operate the same is expensive and therefore prohibitive to the smaller company.

The present invention overcomes the deficiencies found with atmospheric dye machines and provides the industry with an alternative to investing in a pressurized system. Use of the present invention allows an operator to achieve maintainable temperatures of 211 to 212 degrees F. at sea level under atmospheric conditions. The present invention makes use of convection, natural circulation, and pressure differentials to eliminate the deficiencies found in the prior art systems. It also provides the public with an invention readily adaptable to existing dye machinery thereby making it cost effective for the owner to modify and operate this existing machinery at the higher temperatures needed to dye polyesters.

Additional advantages which have proven to be inherent to the present invention are that the present invention can use non-toxic, biodegradeable dye carriers, the quantity of dye necessary for satisfactory results is less than prior art devices, and the production time has been reduced to approximately one-tenth of its former time of 24 hours. The reduction in production time alone provides the dyer with a great deal of time and energy savings.

SUMMARY OF THE INVENTION

It is therefore an object of this invention to provide an apparatus capable of adaptation to an atmospheric dye system which enables the dye bath temperature to exceed the temperature threshold which can otherwise be achieved.

It is another object of the present invention to provide an apparatus that utilizes convection, natural circulation and pressure differentials to realize this higher heat potential.

It is still another object of the present invention to provide an apparatus that does not necessitate the use of pressure to adequately dye polyesters.

Yet another object of this invention is to provide an apparatus that dyes a textile in substantially less time than otherwise achievable by either atmospheric or pressurization of the system.

Still another object of this invention is to provide an apparatus that because it operates more efficiently, uses less energy, water, and dye than the prior art machines.

Still another object of this invention is to provide an apparatus that can utilize non-toxic environmentally safe chemicals—to dye the textiles.

BRIEF DESCRIPTION OF THE DRAWING

The above mentioned and other objects and features of this invention and the manner of attaining them will become apparent, and the invention itself will be best understood by reference to the following description of the embodiment of the invention in conjunction with the accompanying drawings wherein.

DETAILED DESCRIPTION OF A PREFERRED EMBODIMENT

Figure 1:
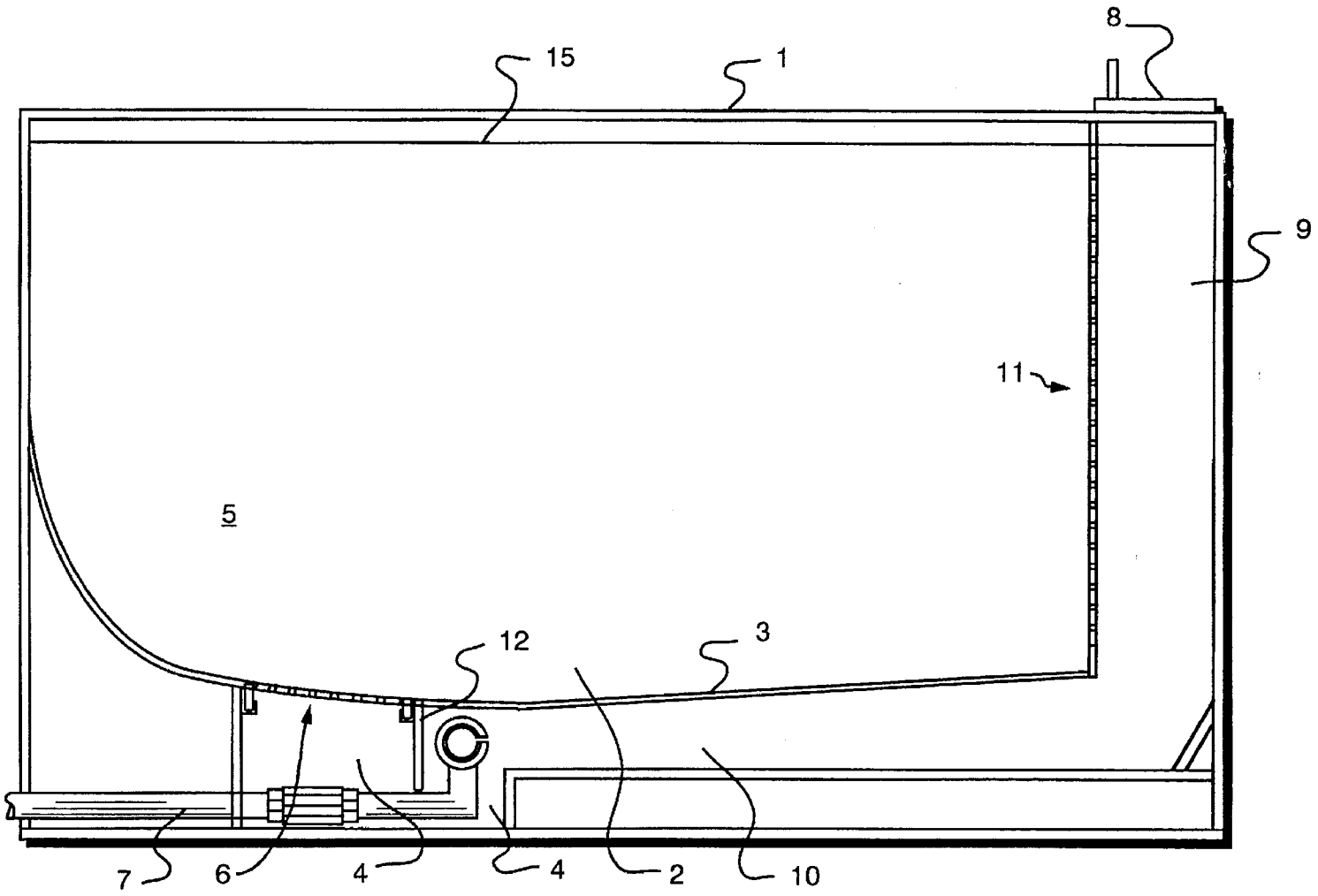
FIG. 1 is a side elevation of a typical atmospheric dye machine modified to depict the elements specific to the present invention.
Figure 1:
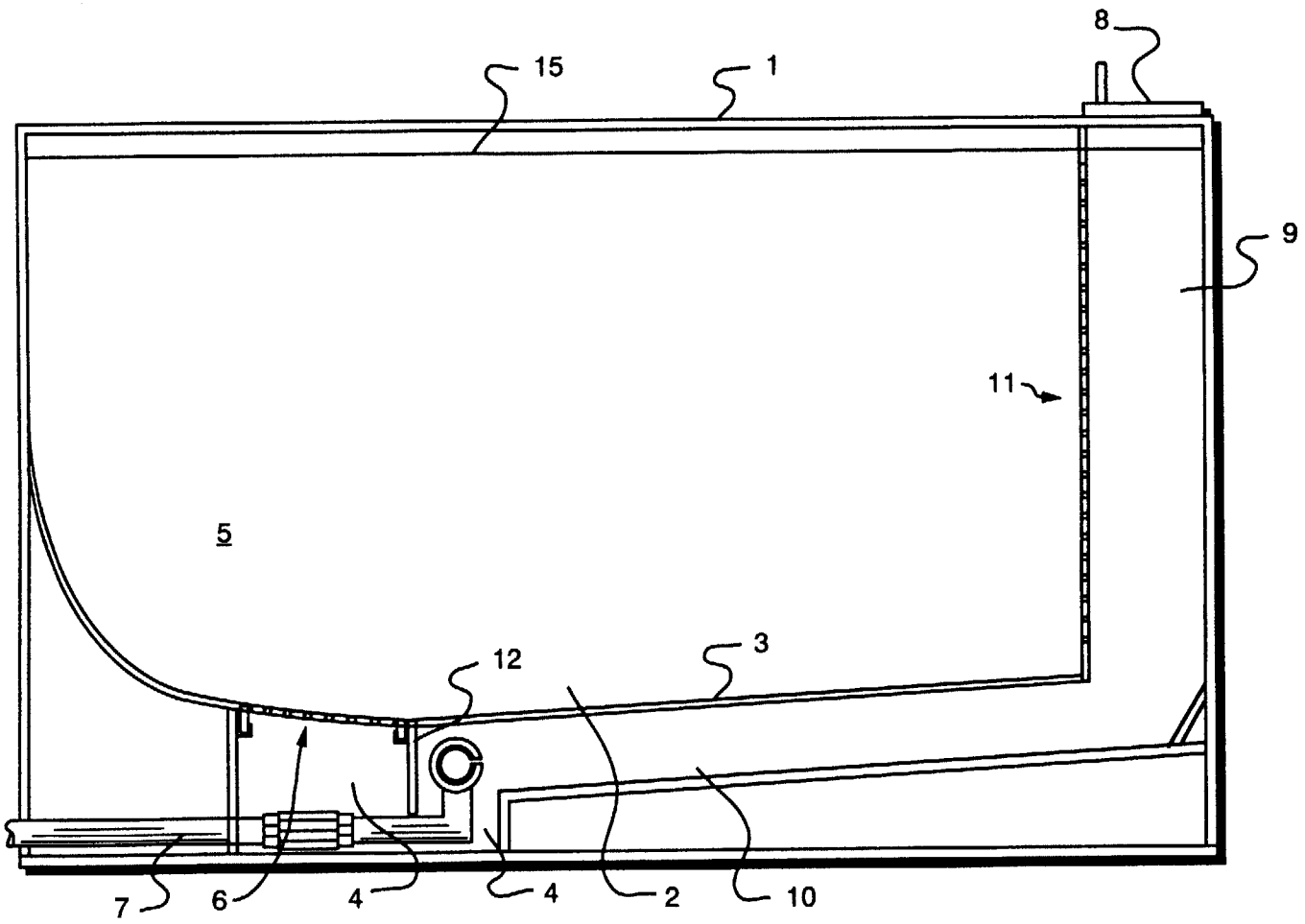

Referring now to FIG. 1, a dye machine containing the preferred embodiment of the present invention is designated generally by the numeral 1. The present invention operates on the same general principles that all atmospheric dye machines use. That is, a liquor bath 2 consisting of a mix of dye, water, and other chemicals is added to the machine 1; and the temperature of bath 2 is raised to the level mandated by a textile undergoing the procedure. The surface of liquor bath 2 within machine 1 is depicted as liquor surface 15. The textile is then spooled or otherwise drawn continuously through the heated liquor bath until completion of the dying process.

Adaptation of an atmospheric dye machine to encompass the present invention requires the addition of a sloped bottom 3, addition of a two chambered well 4 in the bottom of tank 5, a perforated well cover 6 leading to well 4, relocation of sparge tube 7 to well 4, and a chamber cover 8 over chamber 9.

The present invention operates under the principle of injecting steam through sparge tube 7 directly into the liquor that has settled into well 4. The perforations of well cover 6 allow the cooler liquor in bath 2 to drain through well cover 6 and collect in well 4, well cover 6 also serves to cover and isolate the liquor contained within well 4 thereby minimizing the impact convective currents otherwise would have upon the liquor contained within well 4 if it were completely open to bath 2.

The construction of well 4 due to the addition of baffle wall 12 creates two chambers, each open along the bottom to the other, but where the top of one chamber is open solely to tank 5 via well cover 6, the top of the other chamber is open solely to the bottom of spout 10. The steam outlet of sparge tube 7 is located at the top of the spout side chamber of well 4. Location on the spout side of well 4 is important because it provides the steam with a path of least resistance up along spout 10, and prevents the steam from merely bubbling into tank 5 through well cover 6. As the steam and liquor from the well mix, the steam transfers its heat to the liquor and together they progress up sloped bottom 3 along spout 10 thence into chamber 9. Upward movement of the now heated liquor is accomplished primarily by the venturi effect created by the steam being injected and expanding in the liquor within the well, and progressing up along the spout.

Chamber 9 has a hinged chamber cover 8 which serves two important functions; first, by collecting the higher temperature liquor sent to chamber 9 and eliminating any escape path other than through baffle 11, chamber 9 is maintained at a slightly higher pressure relative to tank 5. This higher pressure serves to force the liquor through baffle 11 thereby increasing the rate of circulation and improving convection heat transfer throughout the tank. The second function that chamber cover 8 accomplishes is that it minimizes heat loss to the atmosphere of tank 5 prior to mixing this hotter liquor with the liquor within the tank.

Homogeneous temperatures of 211 to 212 degrees F. are reached by the intermixing of the hotter liquor with the colder liquor accomplished primarily by the increased convective action resulting from the liquor being forced at a slightly higher pressure through baffle 11. However, the higher apparent specific gravity of the colder liquor settling into the well where it is then heated by the steam and reintroduced at a higher temperature into the bath; plus the mechanical mixing resulting from the action of the textile being moved through the bath; also play a role in the homogeneous mixture of heated liquor.

It is to be understood the present invention is not restricted to the above-described embodiment, but may be varied within the scope of the appended claims. Since numerous modifications and changes will readily occur to those skilled in the art, accordingly all such modifications and equivalents which fall within the scope of the claims may be resorted to.

I claim:

1. An apparatus for maintaining near boiling temperatures of a textile dye liquor in an atmospheric dye machine comprising:

a well, said well adapted to be placed at a low point of a tank of said liquor;

a well cover, said well cover capable of allowing said liquor in said tank to pass through said well cover and collect in said well;

a sparge tube, said sparge tube capable of directing an external supply of steam into said well, said steam heating said liquor in said well;

a chamber, said chamber capable of collecting the heated liquor from said well;

a spout, said spout connecting said chamber to said well, said spout providing a path for said heated liquor to follow from said well to said chamber;

a baffle; said baffle separating said chamber from said tank, said baffle capable of permitting said liquor to flow from said chamber to said tank; and a chamber cover, said chamber cover adapted to be placed over said chamber, said chamber cover capable of sealing the top of said chamber to atmosphere around said chamber.

2. An apparatus as claimed in claim 1, wherein said chamber is at a slightly higher pressure than said tank.

3. An apparatus as claimed in claim 2, wherein said baffle is perforated, said perforations permit the slightly pressurized liquor from said chamber to mix with the liquor in said tank.

4. An apparatus as claimed in claim 3, wherein said baffle further comprises a plate with a plurality of holes.

5. An apparatus as claimed in claim 4, wherein said plurality of holes are capable of creating turbulent flow of liquor entering said tank.

6. An apparatus as claimed in claim 1, wherein said well cover further comprises an essentially flat plate containing a plurality of holes.

7. An apparatus as claimed in claim 6, wherein said well further comprises a first and a second chamber, said first chamber is open to said tank via said well cover, said second chamber is open to said spout, said first and second chambers are further open to each other at a point lower than said first and second chambers are open to the tank and spout respectively.

8. An apparatus as claimed in claim 7 wherein said tank further comprises a sloped bottom, on underside of said sloped bottom is said spout, said sloped bottom slopes upward from a low point in said well to a high point in said chamber.

* * * * *

UNITED STATES PATENT AND TRADEMARK OFFICE

CERTIFICATE OF CORRECTION

PATENT NO. : 5,628,211

DATED : May 13, 1997

INVENTOR(S) : Soucie

It is certified that error appears in the above-identified patent and that said Letters Patent is hereby corrected as shown below:

On the title page, FIG. 1 has been deleted and substituted with attached sheet

Please cancel original FIG. 1 and substitute with the attached FIG. 1

Signed and Sealed this

Twenty-first Day of October 1997

Bruce Lehman

*Attest:*

BRUCE LEHMAN

*Attesting Officer*

*Commissioner of Patents and Trademarks*

US005628211A

United States Patent [19]

Soucie

[11] Patent Number: 5,628,211

[45] Date of Patent: May 13, 1997

[54] APPARATUS FOR IMPROVING ATMOSPHERIC DYE MACHINES

[76] Inventor: Donald P. Soucie, 55 Walnut Hill Rd., Pascoag, R.I. 02859

[21] Appl. No.: 517,292

[22] Filed: Aug. 21, 1995

[51] Int. Cl.[6] ..... D06B 23/22

[52] U.S. Cl. ..... 68/15; 68/183

[58] Field of Search ..... 68/15, 183; 134/102.1, 134/102.2, 105; 122/31.1

[56] References Cited

U.S. PATENT DOCUMENTS

| | | | |
|---|---|---|---|
| 3,218,833 | 11/1965 | Booth | 68/15 X |
| 3,593,545 | 7/1971 | Blumenkamp | 68/15 |
| 3,614,798 | 10/1971 | Serbin | 8/149.3 X |
| 3,894,410 | 7/1975 | Fleissner | 68/5 D |
| 4,483,032 | 11/1984 | Christ Et El. | 8/149.1 |
| 4,697,291 | 10/1987 | Shepherd et al. | 68/183 X |
| 4,828,567 | 5/1989 | Robbins | 8/149.3 |

FOREIGN PATENT DOCUMENTS

| | | | |
|---|---|---|---|
| 661018 | 2/1929 | France | 68/183 |

*Primary Examiner*—Philip R. Coe

*Attorney, Agent, or Firm*—Scott B. Garrison; Gary E. Lambert

[57] ABSTRACT

A modification to atmospheric dye machines, in which the modification increases the attainable operating temperatures to a level in which polyester textiles can be successfully dyed. The modification is accomplished by relocating steam injection to a location which takes advantage of venturi principles and harnesses the slight pressurization obtained by injecting steam into the liquor. The combination increases circulation of dye liquor, convective heat transfer and minimizes the formation of isothermal layering of the dye liquor. Dye liquor subject to reheating is drawn from the tank bottom, further decreasing the amounts of cooler dye liquor which may still collect within the tank.

8 Claims, 1 Drawing Sheet

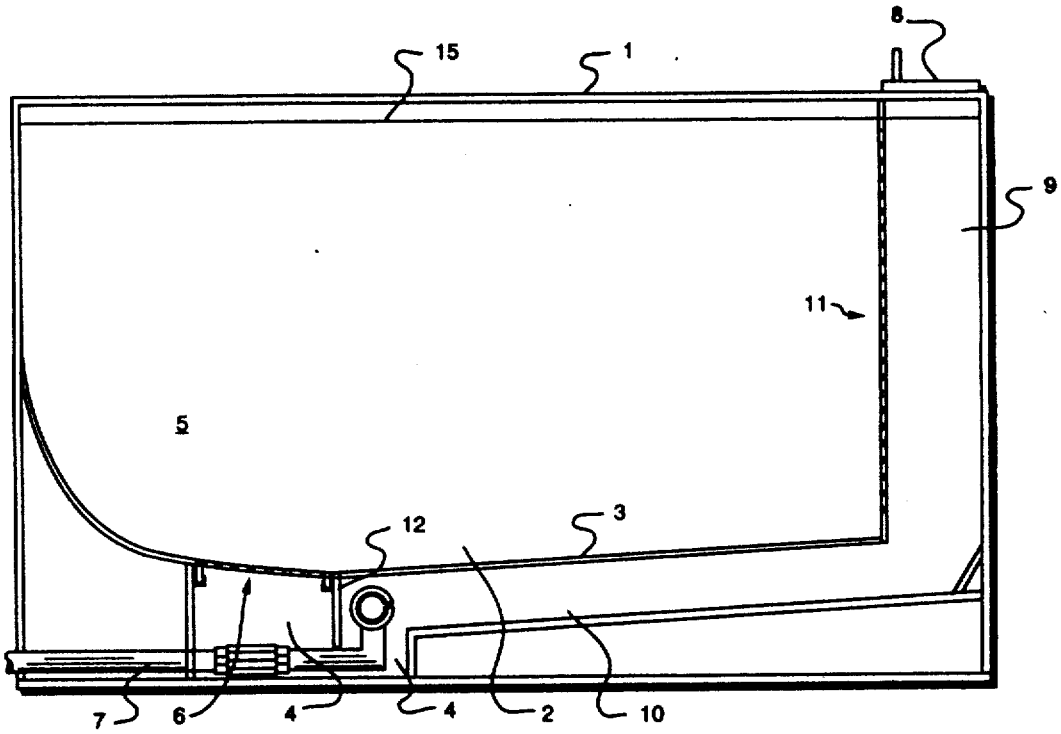

1/1